US008310365B2

(12) United States Patent
Siegler, II et al.

(10) Patent No.: US 8,310,365 B2
(45) Date of Patent: Nov. 13, 2012

(54) CONTROL SYSTEM, SECURITY SYSTEM, AND METHOD OF MONITORING A LOCATION

(75) Inventors: Michael J. Siegler, II, Inver Grove Heights, MN (US); Eric Chabin, Chanhassen, MN (US)

(73) Assignee: UTC Fire & Security Americas Corporation, Inc., Bradenton, FL (US)

( * ) Notice: Subject to any disclaimer, the term of this patent is extended or adjusted under 35 U.S.C. 154(b) by 317 days.

(21) Appl. No.: 12/684,520

(22) Filed: Jan. 8, 2010

(65) Prior Publication Data

US 2011/0169637 A1 Jul. 14, 2011

(51) Int. Cl.
*G08B 13/00* (2006.01)

(52) U.S. Cl. ..... 340/541; 340/540; 340/522; 340/523; 340/524

(58) Field of Classification Search ..... 340/541, 340/540, 517–525
See application file for complete search history.

(56) References Cited

U.S. PATENT DOCUMENTS

| | | | | |
|---|---|---|---|---|
| 5,216,410 | A | 6/1993 | Pildner et al. | |
| 5,475,365 | A | 12/1995 | Hoseit et al. | |
| 5,493,273 | A * | 2/1996 | Smurlo et al. | 340/541 |
| 5,581,236 | A * | 12/1996 | Hoseit et al. | 340/511 |
| 5,638,046 | A | 6/1997 | Malinowski | |
| 5,864,286 | A * | 1/1999 | Right et al. | 340/501 |
| 5,920,270 | A | 7/1999 | Peterson | |
| 6,897,774 | B2 * | 5/2005 | Costa et al. | 340/522 |
| 7,113,090 | B1 | 9/2006 | Saylor et al. | |
| 7,113,099 | B2 | 9/2006 | Tyroler et al. | |
| 7,218,217 | B2 | 5/2007 | Adonailo et al. | |
| 7,298,253 | B2 * | 11/2007 | Petricoin et al. | 340/523 |
| 7,403,109 | B2 | 7/2008 | Martin | |
| 7,642,924 | B2 * | 1/2010 | Andres et al. | 340/628 |
| 2003/0114986 | A1 | 6/2003 | Padmanabhan et al. | |
| 2003/0174056 | A1 * | 9/2003 | Harshaw | 340/522 |
| 2004/0056765 | A1 * | 3/2004 | Anderson et al. | 340/522 |
| 2004/0222884 | A1 * | 11/2004 | Costa et al. | 340/522 |
| 2005/0264413 | A1 * | 12/2005 | Eskildsen | 340/522 |
| 2006/0181407 | A1 * | 8/2006 | Tice | 340/522 |

FOREIGN PATENT DOCUMENTS

| | | | |
|---|---|---|---|
| EP | 0729125 | A1 | 8/1996 |
| EP | 0762358 | A1 | 3/1997 |
| WO | 2005106820 | A1 | 11/2005 |

OTHER PUBLICATIONS

Patent Cooperation Treaty, International Search Report and Written Opinion, Apr. 4, 2011, 11 pages.

* cited by examiner

*Primary Examiner* — Jennifer Mehmood
*Assistant Examiner* — Naomi Small
(74) *Attorney, Agent, or Firm* — MH2 Technology Law Group, LLP

(57) ABSTRACT

A control system for a security system having a plurality of sensors includes a sensor communication device configured to communicatively couple to the plurality of sensors and to receive a plurality of sensor notifications from the plurality of sensors. Each sensor notification of the plurality of sensor notifications includes at least one of a detection type, a detection location, and a detection duration. The control system also includes a processor configured to receive the plurality of sensor notifications from the sensor communication device, associate a plurality of detection states with the plurality of sensor notifications such that at least one detection state of the plurality of detection states is entered upon receiving at least one combination of sensor notifications of the plurality of sensor notifications, and associate at least one detection response with each detection state of the plurality of detection states.

18 Claims, 4 Drawing Sheets

CONTROL SYSTEM, SECURITY SYSTEM, AND METHOD OF MONITORING A LOCATION

BACKGROUND OF THE INVENTION

1. Field of the Invention

The embodiments described herein relate generally to security systems and, more particularly, to a control system, a security system, and a method of monitoring a location to prevent unauthorized intrusion into a location.

2. Description of Related Art

At least some known security systems include a plurality of sensors to detect various conditions within or proximate to a building. The sensors are often coupled to a control panel or other control system that generates one or more alarms when the sensors are triggered. The alarm generation often includes automatically notifying an alarm monitoring company and/or a law enforcement agency. The control panel is typically configured to generate an alarm when any one of the sensors is triggered. In such a configuration, a false alarm rate may be high. For example, if one of the sensors is inadvertently triggered, the control panel may generate a false alarm. If the law enforcement agency is notified and responds to a false alarm, the building owner may be required to reimburse the law enforcement agency for the costs of the response. As such, false alarms may be disruptive and/or costly. Accordingly, a need exists for security systems and/or control panels to reduce false alarms while maintaining a high level of intrusion detection.

BRIEF SUMMARY OF THE INVENTION

In one aspect, a control system for a security system that includes a plurality of sensors is provided. The control system includes a sensor communication device configured to communicatively couple to the plurality of sensors and to receive a plurality of sensor notifications from the plurality of sensors. Each sensor notification of the plurality of sensor notifications includes at least one of a detection type, a detection location, and a detection duration. The control system also includes a processor coupled with the sensor communication device and configured to receive the plurality of sensor notifications from the sensor communication device, associate a plurality of detection states with the plurality of sensor notifications such that at least one detection state of the plurality of detection states is entered upon receiving at least one combination of sensor notifications of the plurality of sensor notifications, and associate at least one detection response with each detection state of the plurality of detection states.

In another aspect, a security system is provided that includes a control system and a plurality of sensors configured to generate a plurality of sensor notifications. Each sensor notification of the plurality of sensor notifications includes at least one of a detection type, a detection location, and a detection duration. The control system includes a sensor communication device configured to communicatively couple to the plurality of sensors and to receive the plurality of sensor notifications from the plurality of sensors. The control system also includes a processor coupled with the sensor communication device. The processor is configured to receive the plurality of sensor notifications from the sensor communication device, associate a plurality of detection states with the plurality of sensor notifications such that at least one detection state of the plurality of detection states is entered upon receiving at least one combination of sensor notifications of the plurality of sensor notifications, and associate at least one detection response with each detection state of the plurality of detection states.

In yet another aspect, a method of monitoring a location is provided that includes receiving a plurality of sensor notifications transmitted by at least one sensor, wherein each sensor notification of the plurality of sensor notifications includes at least one of a detection type, a detection location, and a detection duration. A plurality of detection states is associated with the plurality of sensor notifications such that at least one detection state of the plurality of detection states is entered upon receiving at least one combination of sensor notifications of the plurality of sensor notifications, and at least one detection response is associated with each detection state of the plurality of detection states.

The embodiments described herein use multiple sensors to monitor a location and to provide sensor notifications upon detection of triggering events. The security system compares the sensor notifications to multiple detection conditions to determine one or more detection states to enter. The security system determines different detection responses to be performed within each detection state. By providing a security system with multiple detection states and multiple detection responses for the detection states, the embodiments described herein provide a more intelligent level of intrusion detection.

BRIEF DESCRIPTION OF THE DRAWINGS

FIG. 1 is a block diagram of an exemplary security system.

FIG. 2 is a block diagram of an exemplary control module suitable for use with the security system shown in FIG. 1.

FIG. 3 is a flow diagram of an exemplary method for monitoring a location suitable for use with the security system shown in FIG. 1.

FIG. 4 is a block diagram of an alternative control module suitable for use with the security system shown in FIG. 1.

DETAILED DESCRIPTION OF THE INVENTION

Figure 1:
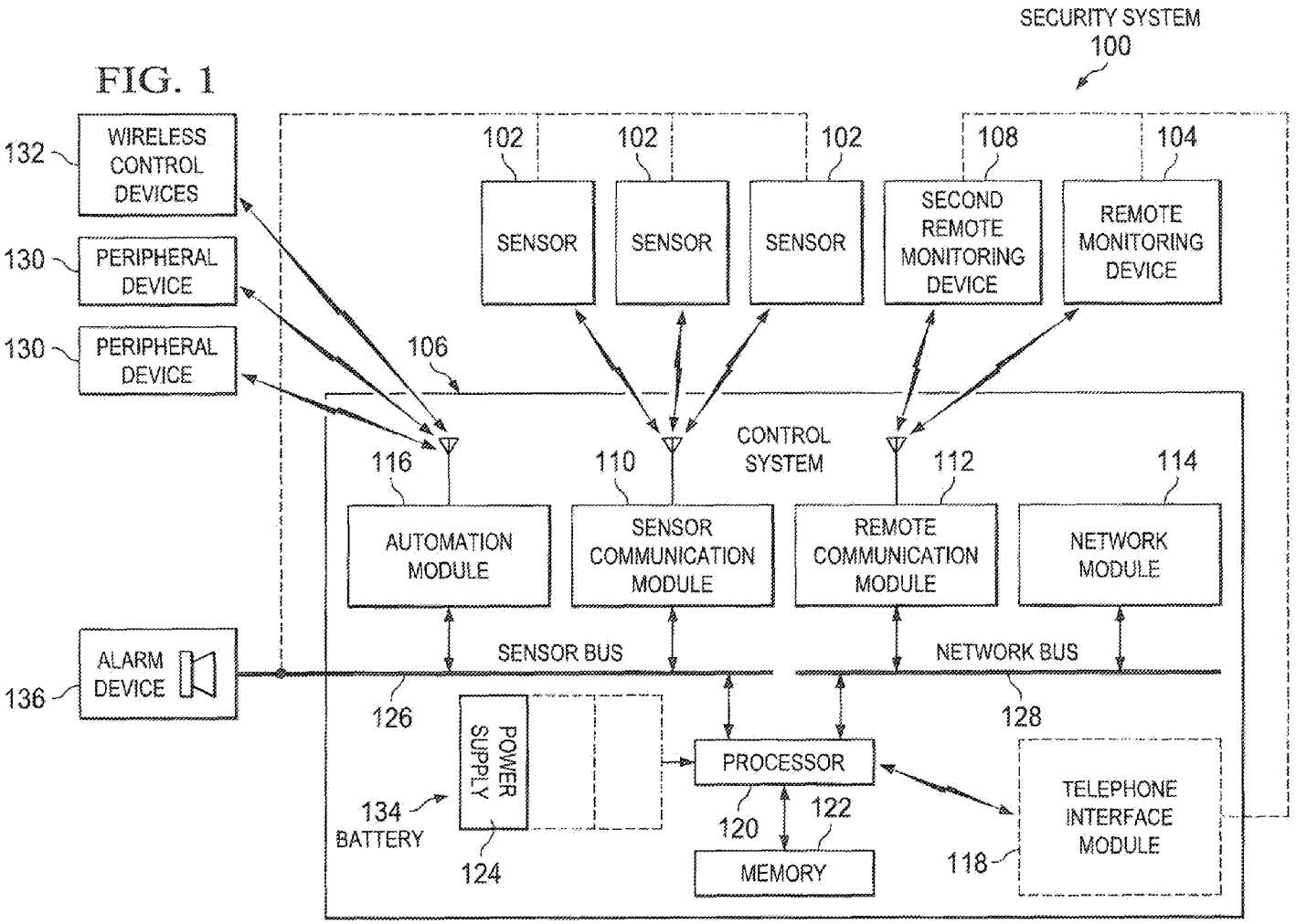
FIGS. 1-4 show exemplary embodiments of the systems and method described herein.

An embodiment of an exemplary security system includes a plurality of sensors that are communicatively coupled to a control panel. The control panel includes a processor that receives a plurality of sensor notifications from the sensors. The processor compares the sensor notifications to a plurality of detection conditions to determine if the detection conditions are satisfied. If one or more detection conditions are satisfied, the processor enters a detection state associated with the satisfied detection condition. Each detection state includes one or more associated detection responses that determine an action to be performed upon entering the detection state. The processor switches between different detection states based on additional conditions being satisfied, such as receiving additional sensor notifications or an elapsing of a predefined time period. In a specific embodiment, an alert state is entered when the processor receives a first sensor notification that satisfies a detection condition of the alert state. An alarm state is entered when the processor receives a combination of sensor notifications that satisfies a detection condition of the alarm state. The embodiments described herein provide additional intelligence to a building security solution to reduce false alarms.

The embodiments described herein use multiple sensors to monitor a location and to provide sensor notifications upon detection of triggering events. The security system compares the sensor notifications to multiple detection conditions to determine one or more detection states to enter. The security system determines different detection responses to be performed within each detection state. By providing a security system with multiple detection states and multiple detection responses for the detection states, the embodiments described herein provide a more intelligent level of intrusion detection.

Many of the components of the security system described herein include a processor. As used herein, the term "processor" is not limited to just those integrated circuits referred to in the art as a computer, but broadly refers to a microcontroller, a microcomputer, a programmable logic controller (PLC), an application specific integrated circuit, and other programmable circuits, and these terms are used interchangeably herein. It should be understood that a processor and/or control system can also include memory, input channels, and/or output channels. In the embodiments described herein, memory may include, but is not limited to, a computer-readable medium, such as a random access memory (RAM), and a computer-readable non-volatile medium, such as flash memory. Alternatively, a floppy disk, a compact disc-read only memory (CD-ROM), a magneto-optical disk (MOD), and/or a digital versatile disc (DVD) may also be used. Also, in the embodiments described herein, input channels include, without limitation, computer peripherals associated with an operator interface, such as a mouse and a keyboard. Further, in the exemplary embodiment, output channels may include, without limitation, an operator interface monitor and/or display.

The processor described herein processes information transmitted from a plurality of electrical and electronic devices that may include, without limitation, security system sensors and/or monitoring devices. Such processor may be physically located in, for example, a control system, sensors, monitoring devices, desktop computers, laptop computers, PLC cabinets, and/or distributed control system (DCS) cabinets. Memory and storage devices store and transfer information and instructions to be executed by the processor. Memory and storage devices can also be used to store and provide temporary variables, static (i.e., non-changing) information and instructions, or other intermediate information to the processors during execution of instructions by the processors. Instructions that are executed may include, without limitation, security system control commands. The execution of sequences of instructions is not limited to any specific combination of hardware circuitry and software instructions.

Further, although the security system as described herein includes sensors, it should be understood that the systems and method described herein may include any suitable remote radio frequency (RF) device that transmits RF signals to a control system configured to receive RF signals.

The security system as described herein includes one or more detection states that are entered by a processor or other control system when one or more detection conditions are satisfied. As used herein, the term "detection state" refers to a logical and/or programmed mode or condition of operation that the processor enters during execution upon satisfaction of one or more requirements. A detection state may include specific and/or unique variables, instructions, and/or data that processor accesses and/or executes upon entering the detection state. As used herein, the term "detection condition" refers to a prerequisite or threshold value or level that one or more measured environmental properties must meet or exceed for a sensor to generate an output, such as a detection notification.

FIG. 1 shows an exemplary security system 100. Security system 100 can be used within residential, commercial, and/or industrial settings. In one embodiment, security system 100 is a residential alarm system. In the exemplary embodiment, security system 100 includes at least one system RF device or sensor 102, a remote monitoring device 104 located remotely from sensor(s) 102, and a control system 106, such as a control panel, located remotely from sensor(s) 102 and remote monitoring device 104. Control system 106 is coupled with sensor(s) 102 and remote monitoring device 104, as described in more detail herein. In one embodiment, sensor(s) 102 and control system 106 are located at different locations within the same building, such as a home, and remote monitoring device 104 is located remotely from the building.

In the exemplary embodiment, security system 100 includes at least one sensor 102. In a more particular embodiment, security system 100 includes a plurality of sensors 102, each coupled with control system 106. For example, in a residential setting, sensors 102 may be located throughout the house and communicate with control system 106 that is located centrally within the house. In the exemplary embodiment, each sensor 102 is considered to be a "wireless" sensor and is not hardwired to control system 106. In one embodiment, sensors 102 communicate with each other to form a network, such as a mesh network. Alternatively, sensors 102 are hardwired or are wireless with a hardwire back-up. In the exemplary embodiment, each sensor 102 is at least one of a motion sensor, a glass-break sensor, a door sensor, a window sensor, a smoke sensor, a temperature sensor, a water sensor, a shock sensor, a carbon monoxide sensor, an accelerometer, and any other suitable type of sensor. Security system 100 includes any suitable combination of types of sensors 102. When each sensor 102 is activated by, for example, detecting a change in a condition and/or detecting a condition satisfying a detection criterion (also referred to as a "triggering condition"), sensor 102 transmits a sensor notification to control system 106.

In the exemplary embodiment, remote monitoring device 104 is a monitoring station or device of an alarm monitoring company. Security system 100 may also optionally include a second remote monitoring device 108 coupled with control system 106. In one embodiment, second remote monitoring device 108 is a homeowner's cellular telephone. Other examples of second remote monitoring device 108 include a secondary monitoring station and/or a law-enforcement device. Alternatively, remote monitoring device 104 and second remote monitoring device 108 are any suitable device configured to communicate with at least control system 106.

In the exemplary embodiment, control system 106 includes a sensor communication module 110, a remote communication module 112, a network module 114, an automation module 116, and an optional telephone interface module 118. Control system 106 also includes a processor 120, a memory 122 coupled to processor 120, and a power supply 124. Processor 120 is coupled in communication with sensor communication module 110 and automation module 116 by a sensor bus 126, and processor 120 is coupled in communication with remote communication module 112 and network module 114 by a network bus 128.

Sensor communication module 110 communicates with and is communicatively coupled to sensor(s) 102 and processor 120. As used herein, the term "communicatively coupled" refers to a component being in data communication with another component, such that data may be transmitted and received between the two components. In the exemplary embodiment, sensor communication module 110 uses any suitable wireless protocol and/or frequency to communicate wirelessly with sensor(s) 102. Sensor communication module 110 receives a plurality of sensor notifications from sensor (s) 102. More specifically, sensor(s) 102 transmits one or more sensor notifications to sensor communication module 110 when a triggering condition occurs. Sensor communication module 110 transmits the sensor notifications to processor 120 through sensor bus 126. Alternatively, sensor communication module 110 communicates with sensor(s) 102 using one or more wires, data cables, and/or any suitable conduit.

In the exemplary embodiment, remote communication module 112 includes a GSM transmitter. Alternatively, remote communication module 112 includes any suitable type or types of transmitter enabling security system 100 to function as described herein. Remote communication module 112 wirelessly communicates with remote monitoring device 104 and/or second remote monitoring device 108. If included, telephone interface module 118 communicates with remote monitoring device 104 and/or second remote monitoring device 108 using a data cable, such as a telephone line. Moreover, telephone interface module 118 enables security system 100 to connect to a public switched telephone network (PSTN). As described more fully herein, remote communication module 112 and/or telephone interface module 118 transmits an alert, an alarm, and/or another notification to remote monitoring device 104 when a suitable condition is satisfied.

Network module 114 enables one or more network devices to communicate with control system 106 using a data cable, such as an Ethernet cable. In the exemplary embodiment, network module 114 includes a network interface card having at least one Ethernet port. Alternatively, network module 114 includes any suitable device that enables security system to function as described herein.

Automation module 116 communicates with one or more peripheral devices 130 within or near the building. Peripheral devices 130 include, for example, lights, video cameras, audio recorders, heating, ventilation, and air conditioning (HVAC) units, appliances, and/or any suitable device capable of being remotely controlled by security system 100. In the exemplary embodiment, automation module 116 communicates wirelessly with peripheral devices 130 and controls an operation of peripheral devices 130. Alternatively, automation module 116 communicates with peripheral devices 130 using one or more data cables. In the exemplary embodiment, one or more wireless control devices 132, such as a key fob and/or a remote control unit, controls an operation of automation module 116 and/or security system 100.

Processor 120 controls an operation of control system 106 and/or security system 100, as more fully described herein. Memory 122 is coupled to processor 120, and memory 122 stores programs and/or data for processor 120 to use during operation of security system 100. In the exemplary embodiment, memory 122 is a non-volatile memory, such as a flash memory. Alternatively, memory 122 is any suitable memory that enables security system 100 to function as described herein.

Power supply 124 provides primary and/or backup power to the components of control system 106. In the exemplary embodiment, power supply 124 includes at least one battery 134. Alternatively, power supply 124 includes any suitable power source that enables security system 100 to function as described herein.

In the exemplary embodiment, an alarm device 136 is coupled to control system 106 through sensor bus 126. Alternatively, alarm device 136 is coupled to control system 106 through network bus 128 or through any suitable interface of control system 106. Alarm device 136 includes one or more strobes, light-emitting diodes (LEDs), sirens, bells, buzzers, and/or any suitable device that generates an audial or visual alarm notification.

During operation, sensors 102 monitor one or more conditions within the building. If a sensor 102 detects a triggering condition (i.e., if sensor 102 is "triggered"), sensor 102 transmits a sensor notification to sensor communication module 110. Sensor communication module 110 transmits the sensor notification to processor 120 through sensor bus 126. Processor 120 compares the sensor notification to one or more detection conditions as more fully described herein. If the sensor notification satisfies the one or more detection conditions, processor 120 generates one or more alarm notifications.

In the exemplary embodiment, remote communication module 112 receives the alarm notification from processor 120 and network bus 128 and transmits the alarm notification to remote monitoring device 104, for example, by initiating a wireless telephone call or wireless data transmission to remote monitoring device 104. Alternatively or additionally, telephone interface module 118 transmits the alarm notification to remote monitoring device 104, for example, by initiating a telephone call to remote monitoring device 104. Additionally, alarm device 136 and/or one or more peripheral devices 130 are activated when the alarm notification is generated. Remote communication module 112 and/or telephone interface module 118 may also transmit test messages or other notifications to remote monitoring device 104 when security system 100 performs a status check and/or a test, or when security system 100 performs any other suitable operation. Remote communication module 112 and/or telephone interface module 118 may also communicate with second remote monitoring device 108 in a similar manner as remote monitoring device 104.

In the exemplary embodiment, a unidirectional communication is transmitted from remote communication module 112 and/or telephone interface module 118 to remote monitoring device 104 and/or second remote monitoring device 108. Alternatively, a bidirectional communication is transmitted between remote communication module 112 and/or telephone interface module 118 and remote monitoring device 104 and/or second remote monitoring device 108. In one embodiment, second remote monitoring device 108 is a cellular telephone requesting a status report from remote communication module 112 of control system 106. In this embodiment, second remote monitoring device 108 initiates communication with remote communication module 112. In an alternative embodiment, processor 120 is configured to automatically report certain events to second remote monitoring device 108 using remote communication module 112.

Figure 2:
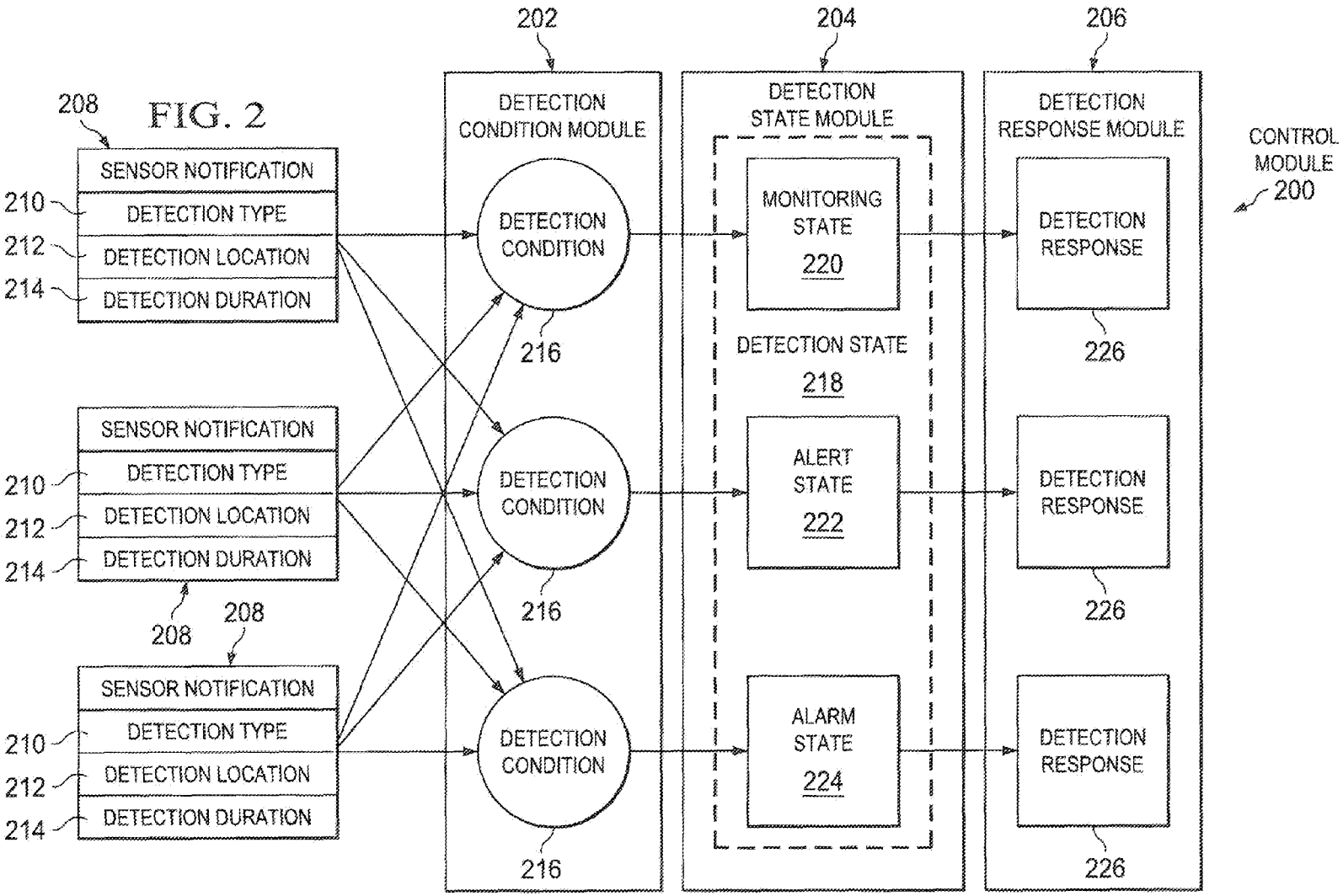

FIG. 2 shows an exemplary control module 200 suitable for use with security system 100 (shown in FIG. 1). In the exemplary embodiment, control module 200 is at least partially implemented by and/or within processor 120 (shown in FIG. 1). Alternatively, control module 200 is implemented by and/or within any suitable component of control system 106 (shown in FIG. 1) and/or security system 100. Control module 200 includes a detection condition module 202, a detection state module 204, and a detection response module 206. Control module 200 receives one or more sensor notifications 208 from one or more sensors 102 (shown in FIG. 1) as described above in reference to FIG. 1.

Each sensor notification 208 includes one or more data components such as a detection type 210, a detection location 212, and/or a detection duration 214. Detection type 210 includes a type of sensor 102 that generated sensor notification 208. In one embodiment, detection type 210 indicates whether sensor 102 is a motion sensor, a door or window sensor, a seismic sensor, or any suitable sensor 102 type. Detection location 212 includes a location or position of sensor 102 that generated sensor notification 208 and/or a location of the triggering event. Detection duration 214 includes a length of time that the triggering event persists and/or a length of time that sensor 102 receives the triggering condition. Sensor notification 208 may include any suitable data component in addition to or instead of detection type 210, detection location 212, and detection duration 214 that enables security system 100 to function as described herein. Alternatively, detection type 210, detection location 212, detection duration 214, and/or any other suitable data component associated with sensor notification 208 are generated and/or determined by processor 120.

In the exemplary embodiment, detection condition module 202 includes one or more detection conditions 216. Processor 120 compares the received sensor notification 208 with one or more detection conditions 216 to determine if detection conditions 216 have been satisfied. Detection conditions 216 include any suitable conditions that enable security system 100 to function as described herein. For example, detection conditions 216 may include receiving sensor notifications 208 from a predefined number of sensors 102 or from a plurality of sensors 102, receiving sensor notifications 208 from one or more sensors 102 that have a predefined priority level, and/or receiving sensor notifications 208 from a plurality of sensors 102 having detection locations 212 within a predefined distance from each other. Detection conditions 216 may also include notifications from devices other than sensors 102. For example, detection condition 216 may include receiving an emergency button or other signal from a wireless control device 132 (shown in FIG. 1) or any suitable notification. Moreover, detection conditions 216 are configurable, such that an authorized operator may modify one or more detection conditions 216.

If processor 120 determines that a detection condition 216 has been satisfied by a sensor notification 208 or other notification, processor 120 enters a detection state 218 associated with detection condition 216. In the exemplary embodiment, detection state module 204 includes a plurality of detection states 218. Detection states 218 represent operating conditions or modes that processor 120 enters upon satisfaction of one or more detection conditions 216. In one embodiment, detection states 218 include a monitoring state 220, an alert state 222, and an alarm state 224. Detection state 218 additionally or alternatively includes a normal or idle operating mode or state (not shown) that processor 120 operates within in the absence of a sensor notification 208 or other notification. Moreover, control module 200 includes any suitable detection state 218 and/or any suitable number of detection states 218. In the exemplary embodiment, detection states 218 are arranged in increasing priority levels. More specifically, monitoring state 220 is a higher priority level than the normal or idle state. Alert state 222 is a higher priority level than monitoring state 220, and alarm state 224 is a higher priority level than alert state 222. In one embodiment, processor 120 moves from a low priority detection state 218 to higher priority detection state 218 based on a received sensor notification 208 and/or a satisfaction of a detection condition 216. For example, processor 120 enters monitoring state 220 if a first sensor notification 208 is received, and moves to alert state 222 if a second sensor notification 208 is received within a predefined time period and/or if an event that triggered the second sensor notification 208 is received within a predefined distance from the event that triggered the first sensor notification 208. In such an embodiment, processor 120 also moves from a high priority detection state 218 to a lower priority detection state 218 based on an absence of a sensor notification 208 and/or a detection condition 216 becoming unsatisfied. Moreover, processor 120 moves to a lower priority detection state 218 if a predefined period of time elapses without receiving additional sensor notifications 208. Alternatively, processor 120 moves between detection states 218 based on any suitable condition or event.

In the exemplary embodiment, detection response module 206 includes a plurality of detection responses 226, and each detection state 218 is associated with at least one detection response 226. Detection responses 226 are actions that a suitable component of security system 100, such as processor 120, implements upon reaching or operating at a particular detection state 218. For example, detection responses 226 may include waiting for additional input or notifications, waiting for a predefined time period to elapse, activating a peripheral device 130 (shown in FIG. 1), initiating a call or data transmission to remote monitoring device 104 and/or to second remote monitoring device 108, and/or generating an alarm notification to one or more components of security system 100. In one embodiment, detection responses 226 are not shared between different detection states 218, but rather each detection state 218 includes one or more detection responses 226 that are distinct from detection responses 226 associated with remaining detection states 218. For example, entering monitoring state 220 may result in processor 120 implementing a monitoring response 228 that includes waiting for additional input and/or sensor notifications 208. Entering alert state 222 may result in processor 120 implementing an alert response 230 that includes activating a peripheral device 130 such as a video camera to record activities within or proximate to detection location 212 of sensor 102. Entering alarm state 224 may result in processor 120 implementing an alarm response 232 that includes generating an alarm notification to one or more components of security system 100. In the exemplary embodiment, one or more detection responses 226 are common or shared with one or more detection states 218.

Detection states 218 and/or detection responses 226 are configurable, such that an authorized operator may modify one or more characteristics of one or more detection states 218 and/or detection responses 226. For example, an authorized operator may change detection conditions 216 that are associated with each detection state 218 and/or may change detection responses 226 that are associated with each detection state 218 as desired.

Although FIG. 2 shows control module 200 having three sensor notifications 208, three detection conditions 216, three detection states 218, and three detection responses 226, control module 200 includes any suitable number of sensor notifications 208, detection conditions 216, detection states 218, and/or detection responses 226.

As described herein, in one embodiment, processor 120 receives at least one sensor notification 208 from each sensor 102 of a plurality of sensors 102. Processor 120 compares individual sensor notifications 208 and/or a combination of sensor notifications 208 to at least one detection condition 216 and, based on the comparison, processor 120 enters a detection state 218 associated with detection condition 216. Processor 120 determines one or more actions to be performed, such as one or more detection responses 226, based on the comparison result and/or based on detection state 218. In one embodiment, processor 120 combines data from multiple sensors and determines one or more actions to be performed, based on whether the combined data satisfies one or more detection conditions 216 of one or more detection states 218. For example, processor 120 may combine data from sensors 102 to determine a size of an intruder and a position status of a door, and generate an alarm notification if the door is open and an adult-sized object has moved through the door. Moreover, processor 120 may use multiple sensors 102 to triangulate or otherwise determine a location of an intrusion or a triggering condition. The determined location of the intrusion or triggering condition may also be included in a sensor notification 208 (i.e., as a detection location 212 component of sensor notification 208) and used in determining if detection condition 216 is satisfied. In a similar manner, detection type 210 and/or detection duration 214 may be used in determining if detection condition 216 is satisfied.

During operation, in the exemplary embodiment, a first sensor 102, such as a door sensor, generates a sensor notification 208 if a door opens a sufficient amount to satisfy a triggering condition of the first sensor 102. Processor 120 receives sensor notification 208 and compares sensor notification 208 to a plurality of detection conditions 216. If no other sensors 102 have transmitted sensor notifications 208 to processor 120, processor 120 may determine that detection condition 216 for alarm state 224 has not been satisfied. However, processor 120 may determine that detection condition 216 for alert state 222 has been satisfied. Accordingly, processor 120 enters alert state 222 but not alarm state 224. Within alert state 222, processor 120 determines one or more alert responses 230 to perform, such as activating a security camera to record an area near the door and/or waiting for additional input. If no other sensor notifications 208 are received within a predefined time, processor 120 may move to monitoring state 220. If another sensor 102, such as a motion sensor, transmits a sensor notification 208 within the predefined time and/or within a predefined distance from the first sensor 102, processor 120 enters alarm state 224. More specifically, processor 120 compares sensor notifications 208 to detection conditions 216, and determines that detection condition 216 for alarm state 224 has been satisfied by the combination of sensor notifications 208. Upon satisfaction of detection condition 216 for alarm state 224, processor 120 enters alarm state 224 and determines an appropriate alarm response 232 to perform, such as generating an alarm notification. Alternatively, any suitable configuration and/or combination of sensors 102, sensor notifications 208, detection conditions 216, detection states 218, and/or detection responses 226 may be selected for processor 120 and/or security system 100.

In an alternative embodiment, a remote system, such as remote monitoring device 104, a computer (not shown) coupled to security system 100 and/or control system 106 through the internet, or any suitable remote system, performs the detection and/or alert determinations that processor 120 would otherwise perform. In such an embodiment, the remote system includes a processor (not shown) and/or another suitable controller or control system that performs one or more functions of processor 120 described herein, such as, for example, determining whether a detection condition 216 has been satisfied, determining a detection state 218 to enter, and/or determining a detection response 226 to perform. For example, control system 106 and/or sensor communication module 110 receives one or more sensor notifications 208 from one or more sensors 102. Processor 120, remote communication module 112, and/or any suitable component of control system 106 transmits sensor notifications 208 and/or any suitable data to the remote system. The remote system compares individual sensor notifications 208, a combination of sensor notifications 208, and/or any suitable data to at least one detection condition 216 and, based on the comparison, the remote system enters a detection state 218 associated with detection condition 216. The remote system determines one or more actions to be performed, such as one or more detection responses 226, based on the comparison result and/or based on detection state 218. Additionally or alternatively, any suitable operation of security system 100, control system 106, and/or processor 120 may be performed by the remote system.

As described herein, security system 100, control system 106, processor 120, the remote system, and/or any suitable combination thereof monitors a location such as, for example, building 102. Security system 100, control system 106, processor 120, and/or the remote system receives a plurality of sensor notifications 208 transmitted by at least one sensor 102, wherein each sensor notification 208 of the plurality of sensor notifications 208 includes at least one of a detection type 210, a detection location 212, and a detection duration 214. A plurality of detection states 218 are associated with the plurality of sensor notifications 208 such that at least one detection state 218 of the plurality of detection states 218 is entered upon receiving at least one combination of sensor notifications 208 of the plurality of sensor notifications 208. At least one detection response 226 is associated with each detection state 218 of the plurality of detection states 218.

Figure 3:
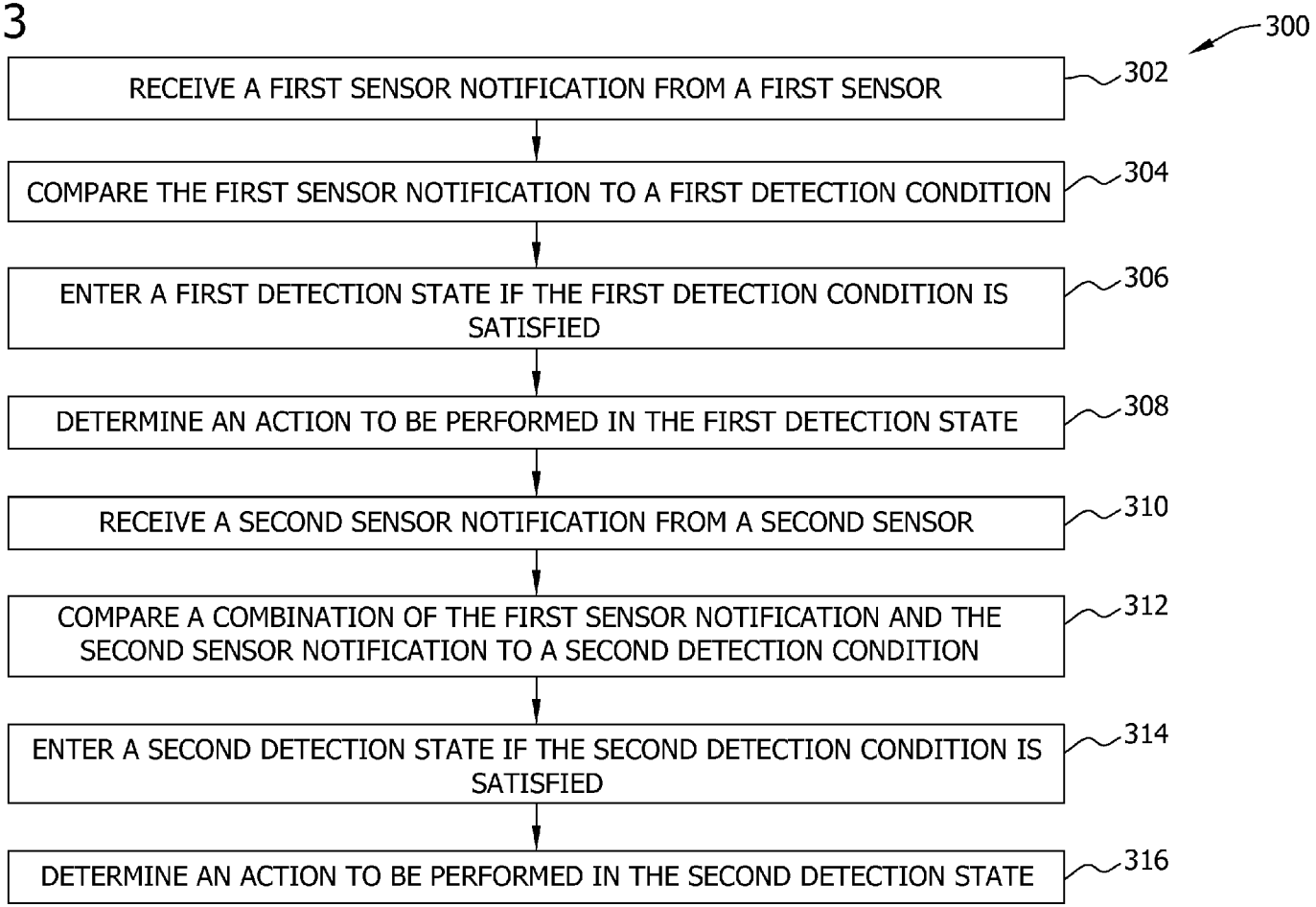

FIG. 3 shows an exemplary method 300 for monitoring a location, such as a building. Method 300 includes receiving 302 a first sensor notification 208 (shown in FIG. 2) from a first sensor 102 (shown in FIG. 1). Processor 120 (shown in FIG. 1) compares 304 the first sensor notification 208 to a first detection condition 216 (shown in FIG. 2) to determine if the first detection condition 216 is satisfied. If the first detection condition 216 is satisfied, processor 120 enters 306 a first detection state 218 (shown in FIG. 2). Processor 120 determines 308 an action, such as a first detection response 226 (shown in FIG. 2), to be performed in the first detection state 218.

Processor 120 receives 310 a second sensor notification 208 from a second sensor 102. The second sensor notification 208 is received 310 after the first sensor notification 208 or substantially concurrently with the first sensor notification 208. Processor 120 compares 312 a combination of the first sensor notification 208 and the second sensor notification 208 to a second detection condition 216 to determine if the second detection condition 216 is satisfied. Alternatively, processor 120 compares 312 only the second sensor notification 208 with the second detection condition 216. In the exemplary embodiment, processor 120 enters 314 a second detection state 218 if the second detection condition 216 is satisfied. If both the first sensor notification 208 and the second sensor notification 208 are received 310 substantially concurrently, processor 120 may enter 314 the second detection state 218 without first entering 306 the first detection state 218. Processor 120 determines 316 an action, such as a second detection response 226, to be performed in the second detection state 218. In the exemplary embodiment, the first detection response 226 is different from the second detection response 226. Moreover, the first detection response 226 and/or the second detection response 226 include a plurality of actions or responses to be performed by processor 120 and/or by any suitable component of security system 100 (shown in FIG. 1). Alternatively, one or more actions or responses of the first detection response 226 is substantially similar to one or more actions or responses of the second detection response 226. Although method 300 is described as being implemented by processor 120, method 300 may be implemented by any suitable component of security system 100.

In one embodiment, method 300 monitors a location by receiving a plurality of sensor notifications transmitted by at least one sensor, wherein each sensor notification of the plurality of sensor notifications includes at least one of a detection type, a detection location, and a detection duration. A plurality of detection states is associated with the plurality of sensor notifications such that at least one detection state of the plurality of detection states is entered upon receiving at least one combination of sensor notifications of the plurality of sensor notifications, and at least one detection response is associated with each detection state of the plurality of detection states.

Figure 4:
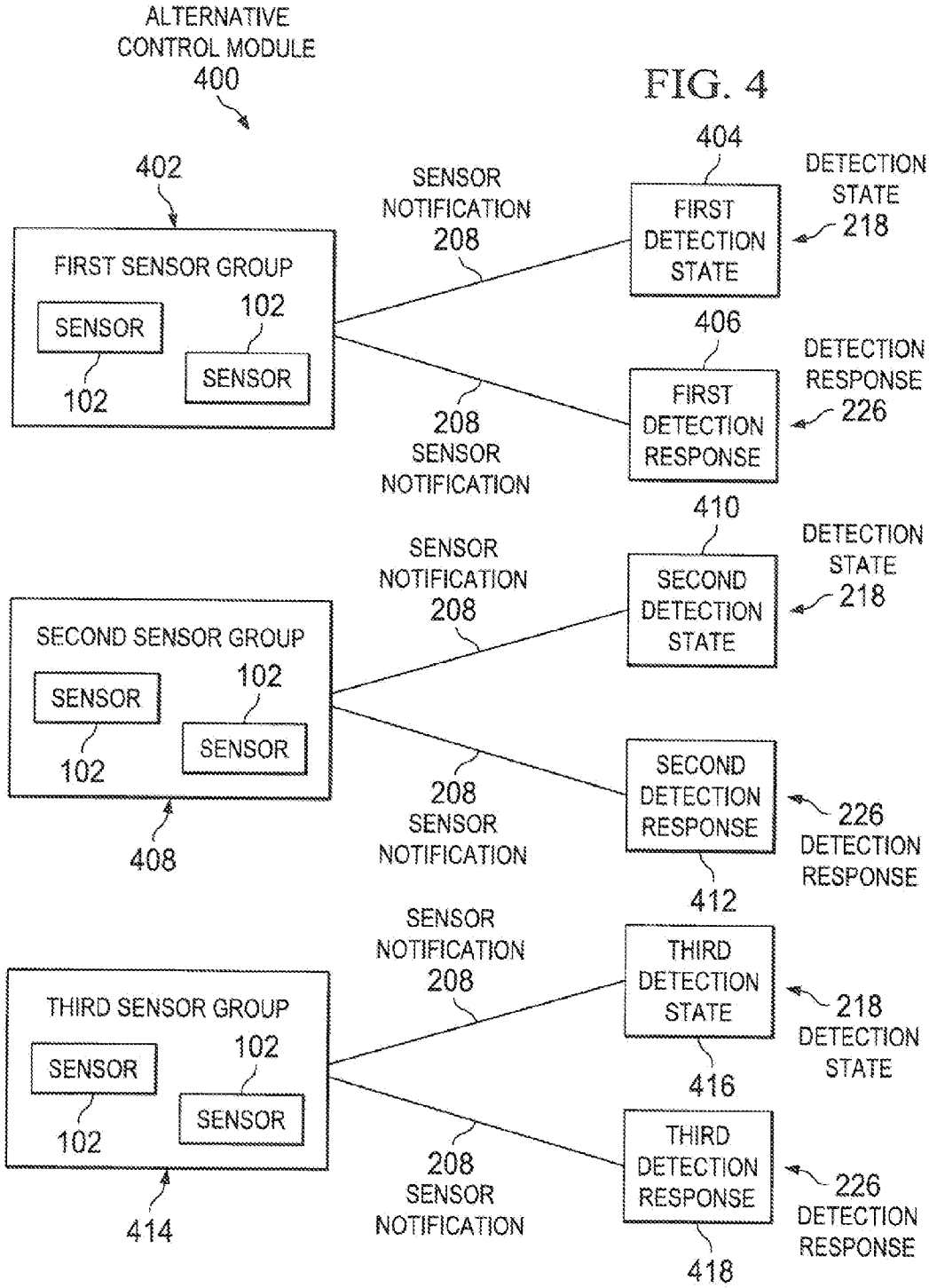

FIG. 4 shows a portion of an alternative control module 400. Unless otherwise specified, control module 400 is substantially similar to control module 200 (shown in FIG. 2), and similar components of FIG. 4 are numbered with the same reference numerals as FIG. 2. In the alternative embodiment, one or more sensors 102 and/or sensor notifications 208 are associated with specific detection states 218 and/or detection responses 226, such that processor 120 (shown in FIG. 1) enters the associated detection state 218 and/or implements the associated detection response 226 upon receiving the respective sensor notification 208. For example, a first sensor 102 or a first sensor group 402 is associated with a first detection state 404, such as monitoring state 220 (shown in FIG. 2) and/or is associated with a first detection response 406, such as monitoring response 228 (shown in FIG. 2). A second sensor 102 or a second sensor group 408 is associated with a second detection state 410, such as alert state 222 (shown in FIG. 2) and/or is associated with a second detection response 412, such as alert response 230 (shown in FIG. 2). A third sensor 102 or a third sensor group 414 is associated with a third detection state 416, such as alarm state 224 (shown in FIG. 2) and/or is associated with a third detection response 418, such as alarm response 232 (shown in FIG. 2). Alternatively, any suitable number of sensors 102 and/or sensor groups may be associated with any suitable detection state 218 and/or detection response 226.

The above-described embodiments facilitate monitoring and securing a location and reducing a number of false alarm notifications. The security system described herein uses multiple sensors and multiple sensor types to provide multiple sensor notifications regarding a potential intrusion. The security system compares the sensor notifications to multiple detection conditions to determine one or more appropriate detection responses. The security system uses multiple detection states to verify triggering events from one sensor with data from other sensors. As such, the security system verifies potential intrusion events and allows more accurate reporting of intrusions to alarm monitoring companies, law enforcement personnel, and property owners.

A technical effect of the systems and method described herein includes at least one of: (a) reducing false alarm notifications in a security system, (b) detecting intrusions within a building, (c) comparing sensor notifications to a plurality of detection conditions to determine whether the detection conditions are satisfied, (d) associating a plurality of detection states with a plurality of detection conditions such that each detection state is entered when the respective detection condition is satisfied, and (e) associating a plurality of detection states with at least one detection response.

Exemplary embodiments of a control system, security system, and method of monitoring a location are described above in detail. The method, control system, and security system are not limited to the specific embodiments described herein, but rather, components of systems and/or steps of the method may be utilized independently and separately from other components and/or steps described herein. For example, the method may also be used in combination with other intrusion-detection systems and methods, and are not limited to practice with only the security systems and methods as described herein. Rather, the exemplary embodiment can be implemented and utilized in connection with many other security applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A control system for a security system that includes a plurality of sensors, the control system comprising:

a sensor communication device configured to communicatively couple to the plurality of sensors and to receive a plurality of sensor notifications from the plurality of sensors; and a processor communicatively coupled with the sensor communication device and configured to:

receive, from a first sensor in the plurality of sensors, a first notification that the first sensor has detected a triggering condition, wherein the first notification comprises a location of the first sensor;

set an alert state in response to receiving the first notification from the first sensor;

receive, from a second sensor in the plurality of sensors, a second notification that the second sensor has detected a triggering condition, wherein the second notification comprises a location of the second sensor;

compare the location of the first sensor to the location of the second sensor to determine whether the location of the first sensor and the location of the second sensor are within a predefined distance; and set an alarm state in response to the location of the first sensor and the location of the second sensor being within the predefined distance, wherein the alarm state has a higher priority level than the alert state.

2. A control system in'accordance with claim 1, wherein the processor is further configured to initiate an alarm response in response to setting the alarm state.

3. A control system in accordance with claim 2, wherein the alarm response comprises transmitting a notification of the alarm state.

4. A control system in accordance with claim 1, wherein the processor is further configured to activate, in response to setting the alert state, a peripheral device that is within proximity to the first sensor.

5. A control system in accordance with claim 1, the first notification further comprises a type of the first sensor and a duration of the triggering condition detected by the first sensor and wherein the second notification further comprises a type of the second sensor and a duration of the triggering condition detected by the second sensor.

6. A control system in accordance with claim 1 wherein the processor is further configured to compare prior to setting the alert state, the first notification to a detection condition; and set the alert state in response to the first notification meeting the detection condition.

7. A security system, comprising:

a plurality of sensors configured to generate a plurality of sensor notifications, a sensor communication device configured to communicatively couple to the plurality of sensors and to receive the plurality of sensor notifications from the plurality of sensors; and a processor communicatively coupled with the sensor communication device and configured to:

receive, from a first sensor in the plurality of sensors, a first notification that the first sensor has detected a triggering condition, wherein the first notification comprises a location of the first sensor;

set an alert state in response to receiving the first notification from the first sensor;

receive, from a second sensor in the plurality of sensors, a second notification that the second sensor has detected a triggering condition, wherein the second notification comprises a location of the second sensor;

compare the location of the first sensor to the location of the second sensor to determine whether the location of the first sensor and the location of the second sensor are within a predefined distance; and set an alarm state in response to the location of the first sensor and the location of the second sensor being within the predefined distance, wherein the alarm state has a higher priority level than the alert state.

8. A security system in accordance with claim 7, wherein the processor is further configured to initiate an alarm response in response to setting the alarm state.

9. A security system in accordance with claim 8, wherein the alarm response comprises transmitting a notification of the alarm state.

10. A security system in accordance with claim 7, wherein the processor is further configured to activate, in response to setting the alert state, a peripheral device that is within proximity to the first sensor.

11. A security system in accordance with claim 7, wherein the first notification further comprises a type of the first sensor and a duration of the triggering condition detected by the first sensor and wherein the second notification further comprises a type of the second sensor and a duration of the triggering condition detected by the second sensor.

12. A security system in accordance with claim 7, wherein the processor is further configured to compare, prior to setting the alert state, the first notification to a detection condition; and set the alert state in response to the first notification meeting the detection condition.

13. A method of monitoring security conditions using a plurality of sensors, the method comprising:

receiving, from a first sensor in the plurality of sensors, a first notification that the first sensor has detected a triggering condition, wherein the first notification comprises a location of the first sensor;

setting an alert state in response to receiving the first notification from the first sensor;

receiving, from a second sensor in the plurality of sensors, a second notification that the second sensor has detected a triggering condition, wherein the second notification comprises a location of the second sensor;

comparing the location of the first sensor to the location of the second sensor to determine whether the location of the first sensor and the location of the second sensor are within a predefined distance; and setting an alarm state in response to the location of the first sensor and the location of the second sensor being within the predefined distance, wherein the alarm state has a higher priority level than the alert state.

14. The method of claim 13, the method further comprising:

initiating an alarm response in response to setting the alarm state.

15. The method of claim 14, wherein the alarm response comprises transmitting a notification of the alarm state.

16. The method of claim 13, the method further comprising:

activating, in response to setting the alert state, a peripheral device that is within proximity to the first sensor.

17. The method of claim 13, wherein the first notification further comprises a type of the first sensor and a duration of the triggering condition detected by the first sensor and wherein the second notification further comprises a type of the second sensor and a duration of the triggering condition detected by the second sensor.

18. The method of claim 13, the method further comprising:

comparing, prior to setting the alert state, the first notification to a detection condition; and setting the alert state in response to the first notification meeting the detection condition.

* * * * *